US010711561B2

(12) United States Patent
Merron et al.

(10) Patent No.: US 10,711,561 B2
(45) Date of Patent: Jul. 14, 2020

(54) EXTRUSION LIMITING RING FOR WELLBORE ISOLATION DEVICES

(71) Applicant: Halliburton Energy Services, Inc., Houston, TX (US)

(72) Inventors: Matthew James Merron, Carrollton, TX (US); Tyler Joseph Norman, Duncan, OK (US)

(73) Assignee: Halliburton Energy Sevices, Inc., Houston, TX (US)

( * ) Notice: Subject to any disclaimer, the term of this patent is extended or adjusted under 35 U.S.C. 154(b) by 121 days.

(21) Appl. No.: 15/772,803

(22) PCT Filed: Jan. 11, 2016

(86) PCT No.: PCT/US2016/012877
§ 371 (c)(1),
(2) Date: May 1, 2018

(87) PCT Pub. No.: WO2017/123198
PCT Pub. Date: Jul. 20, 2017

(65) Prior Publication Data

US 2018/0313184 A1 Nov. 1, 2018

(51) Int. Cl.
*E21B 33/128* (2006.01)
*E21B 33/12* (2006.01)
*E21B 33/129* (2006.01)

(52) U.S. Cl.
CPC ..... *E21B 33/1216* (2013.01); *E21B 33/128* (2013.01); *E21B 33/1293* (2013.01)

(58) Field of Classification Search
CPC ..... E21B 33/134; E21B 33/1216
See application file for complete search history.

(56) References Cited

U.S. PATENT DOCUMENTS

| | | | |
|---|---|---|---|
| 5,617,918 | A | 4/1997 | Cooksey et al. |
| 6,598,672 | B2 | 7/2003 | Bell et al. |
| 7,373,973 | B2 | 5/2008 | Smith et al. |
| 8,403,036 | B2 | 3/2013 | Neer et al. |
| 2010/0052259 | A1 | 3/2010 | Lewis |

(Continued)

FOREIGN PATENT DOCUMENTS

EP 1197632 A2 4/2002

OTHER PUBLICATIONS

International Search Report and Written Opinion from PCT/US2016/012877, dated Sep. 28, 2016, 17 pages.

*Primary Examiner* — D. Andrews
(74) *Attorney, Agent, or Firm* — McGuireWoods LLP

(57) ABSTRACT

A wellbore isolation device includes an elongate mandrel, a sealing element carried by the mandrel, and a slip wedge positioned about the mandrel axially adjacent the sealing element and providing an outer radial surface. A set of slip segments is circumferentially disposed about the mandrel and at least a portion of the slip wedge. An extrusion limiting ring has an annular body that provides a first axial end, a second axial end, and a scarf cut extending at least partially between the first and second axial ends. The extrusion limiting ring is movable between a contracted state, where the extrusion limiting ring is disposed about the sealing element, and an expanded state, where the extrusion limiting ring is disposed about the outer radial surface of the lower slip wedge.

19 Claims, 4 Drawing Sheets

(56) References Cited

U.S. PATENT DOCUMENTS

| | | | | |
|---|---|---|---|---|
| 2012/0061105 | A1 | 3/2012 | Neer et al. | |
| 2012/0205872 | A1 | 8/2012 | Reinhardt et al. | |
| 2015/0233201 | A1* | 8/2015 | Kvinnesland | E21B 10/02 175/57 |
| 2016/0123100 | A1* | 5/2016 | Tse | E21B 23/06 166/387 |
| 2016/0201425 | A1* | 7/2016 | Walton | E21B 33/1208 166/376 |

* cited by examiner

EXTRUSION LIMITING RING FOR WELLBORE ISOLATION DEVICES

BACKGROUND

In the drilling, completion, and stimulation of hydrocarbon-producing wells, a variety of downhole tools are used. For example, during hydraulic fracturing operations it is required to seal portions of a wellbore to allow fluid to be pumped into the wellbore and forced out under pressure into surrounding subterranean formations. Wellbore isolation devices, such as packers, bridge plugs, and fracturing plugs (alternately referred to as "frac" plugs) are designed for this purpose.

Typical wellbore isolation devices include a body and a sealing element disposed about the body and used to generate a seal within the wellbore. Upon reaching a desired location within the wellbore, the wellbore isolation device is actuated by hydraulic, mechanical, electrical, or electromechanical means to cause the sealing element to expand radially outward and into sealing engagement with the inner wall of the wellbore, or alternatively with casing lining the wellbore, or the inner wall of other piping or tubing positioned within the wellbore. Upon setting the sealing element, the migration of fluids across the wellbore isolation device is substantially prevented, which fluidly isolates the axially adjacent upper and lower sections of the wellbore.

At elevated pressures and temperatures common to downhole environments, the material used to form the sealing element tends to creep and extrude through small gaps provided by various components of the wellbore isolation device. Excessive extrusion of this material reduces the sealing capacity of the sealing element, which could result in well fluids leaking past the wellbore isolation device.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present application is related to downhole tools used in the oil and gas industry and, more particularly, to wellbore isolation devices that incorporate an extrusion limiting ring that mitigates extrusion of sealing element material in elevated temperature and pressure downhole environments.

The embodiments disclosed herein provide an extrusion limiting ring that can be used with a wellbore isolation device. The extrusion limiting ring defines a scarf cut that allows the extrusion limiting ring to expand radially as the wellbore isolation device is actuated without creating any axial gaps for sealing element material to extrude. The wellbore isolation devices described herein include at least a sealing element, a slip wedge positioned axially adjacent the sealing element, and a set of slip segments circumferentially disposed about at least a portion of the slip wedge. An extrusion limiting ring is disposed about the sealing element and has an annular body that defines a scarf cut extending at least partially between its first and second axial ends. Upon reaching a desired location within a wellbore, the wellbore isolation device is actuated to radially expand the sealing element and thereby seal the wellbore at the desired location. Radially expanding the sealing element also moves the extrusion limiting ring from a contracted state, where the extrusion limiting ring is disposed about the sealing element, to an expanded state, where the extrusion limiting ring is disposed about an outer radial surface of the lower slip wedge. The extrusion limiting ring may prove advantageous in preventing a material of the sealing element from extruding axially across the outer radial surface and into axial gaps formed between angularly adjacent slip segments of the set of slip segments.

Figure 1:
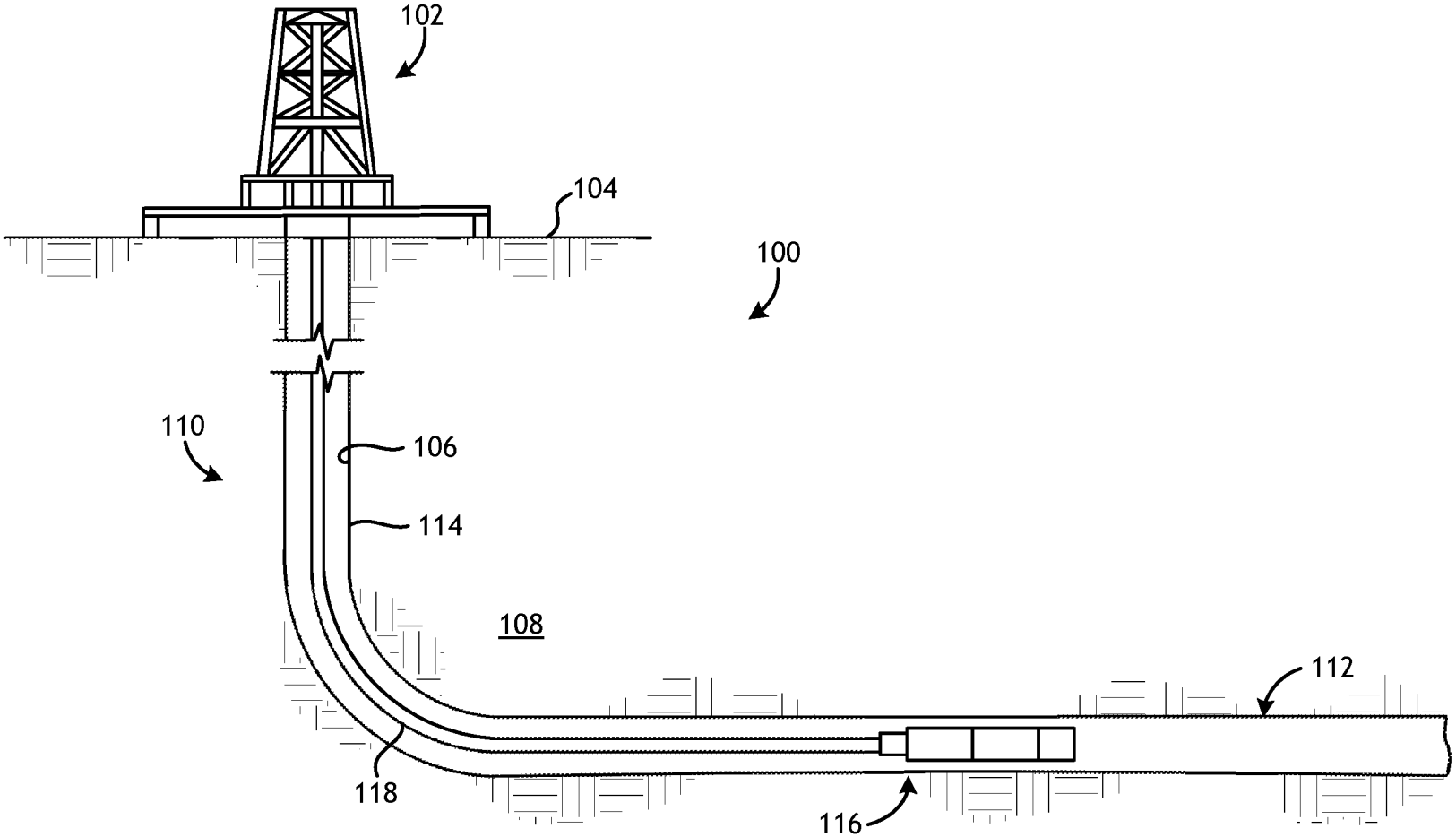
FIG. 1 is a schematic diagram of a well system that may employ one or more principles of the present disclosure.

Referring to FIG. 1, illustrated is a well system 100 that may incorporate the principles of the present disclosure, according to one or more embodiments. As illustrated, the well system 100 may include a service rig 102 that is positioned on the Earth's surface 104 and extends over and around a wellbore 106 that penetrates a subterranean formation 108. The service rig 102 may comprise a drilling rig, a completion rig, a workover rig, or the like. In some embodiments, the service rig 102 may be omitted and replaced with a standard surface wellhead completion or installation, without departing from the scope of the disclosure. While the well system 100 is depicted as a land-based operation, it will be appreciated that the principles of the present disclosure could equally be applied in any sea-based or sub-sea application where the service rig 102 may be a floating platform or sub-surface wellhead installation, as generally known in the art.

The wellbore 106 may be drilled into the subterranean formation 108 using any suitable drilling technique and may extend in a substantially vertical direction away from the Earth's surface 104 over a vertical wellbore portion 110. At some point in the wellbore 106, the vertical wellbore portion 110 may deviate from vertical and transition into a substantially horizontal wellbore portion 112. In some embodiments, the wellbore 106 may be completed by cementing a string of casing 114 within the wellbore 106 along all or a portion thereof. In other embodiments, however, the casing 114 may be omitted from all or a portion of the wellbore 106 and the principles of the present disclosure may alternatively apply to an "open-hole" environment.

The system 100 may further include a wellbore isolation device 116 that may be conveyed into the wellbore 106 on a conveyance 118 that extends from the service rig 102. The wellbore isolation device 116 may include any type of casing or borehole isolation device known to those skilled in the art. Example wellbore isolation devices 116 include, but are not limited to, a frac plug, a bridge plug, a wellbore packer, a wiper plug, a cement plug, a sliding sleeve, or any combination thereof. The conveyance 118 that delivers the wellbore isolation device 116 downhole may be, but is not limited to, wireline, slickline, an electric line, coiled tubing, drill pipe, production tubing, or the like.

The wellbore isolation device 116 may be conveyed downhole to a target location within the wellbore 106. In some embodiments, the wellbore isolation device 116 is pumped to the target location using hydraulic pressure applied from the service rig 102. In such embodiments, the conveyance 118 serves to maintain control of the wellbore isolation device 116 as it traverses the wellbore 106 and provides the necessary power to actuate and set the wellbore isolation device 116 upon reaching the target location. In other embodiments, the wellbore isolation device 116 freely falls to the target location under the force of gravity. Upon reaching the target location, the wellbore isolation device 116 may be actuated or "set" and thereby provide a point of fluid isolation within the wellbore 106.

Even though FIG. 1 depicts the wellbore isolation device 116 as being arranged and operating in the horizontal portion 112 of the wellbore 106, the embodiments described herein are equally applicable for use in portions of the wellbore 106 that are vertical, deviated, curved, or otherwise slanted. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2A:
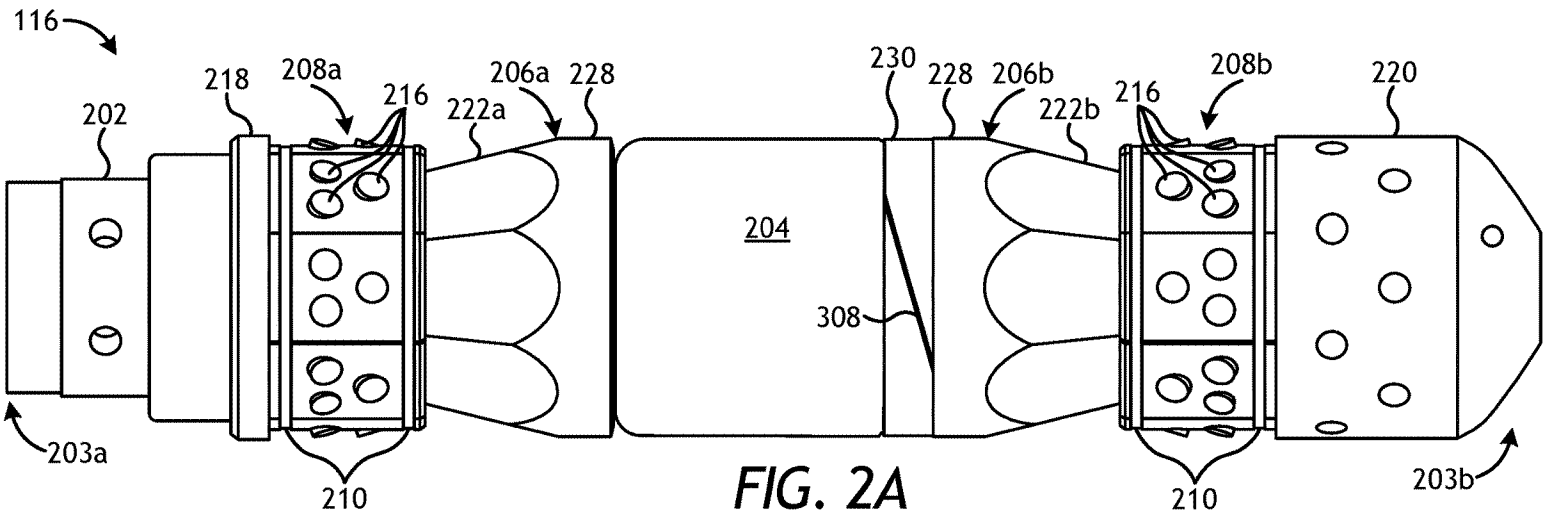
FIGS. 2A and 2B are side views of an exemplary embodiment of the wellbore isolation device of FIG. 1.
Figure 2B:
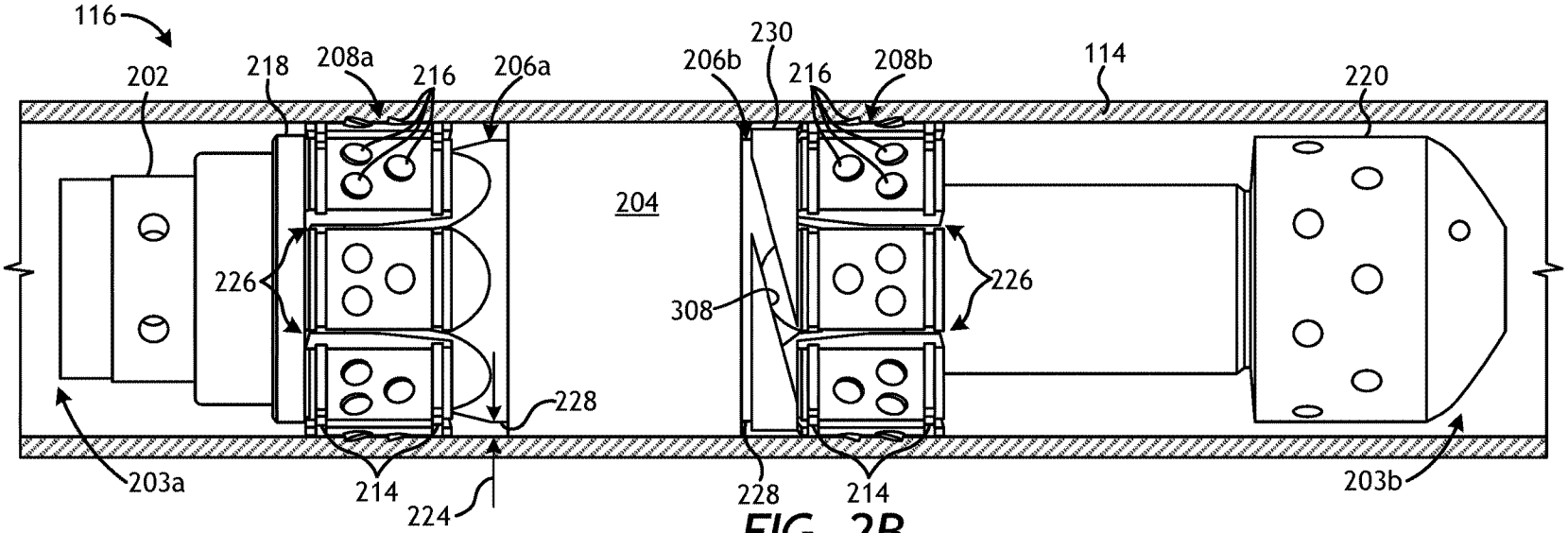

FIGS. 2A and 2B are side views of an exemplary embodiment of the wellbore isolation device 116 of FIG. 1. FIG. 2A depicts the wellbore isolation device 116 in an unset configuration and FIG. 2B depicts the wellbore isolation device 116 in a set configuration within the casing 114. The wellbore isolation device 116 is depicted in FIGS. 2A-2B as a frac plug, but it will be appreciated that the principles of the present disclosure are equally applicable to any of the wellbore isolation devices mentioned herein. Accordingly, the specific configuration of the wellbore isolation device 116 shown in FIGS. 2A-2B is for illustrative purposes only and should not be considered as limiting the scope of the present disclosure.

As illustrated, the wellbore isolation device 116 includes an elongate mandrel 202 having a first end 203*a*, a second end 203*b*, and a sealing element 204 positioned about and otherwise carried by the mandrel 202 at an intermediate location between the first and second ends 203*a,b*. As used herein, the term "sealing element" refers to an expandable, inflatable, or swellable element that is able to radially expand to sealingly engage the inner wall of the casing 114 (FIG. 2B), or alternatively to sealingly engage the inner wall of the wellbore 106 (FIG. 1) or another type of wellbore pipe disposable within the wellbore 106. The sealing element 204 may be made of a variety of pliable or supple materials such as, but not limited to, an elastomer, a rubber (e.g., nitrile butadiene rubber, hydrogenated nitrile butadiene rubber, polyurethane, etc.), a polymer (e.g., polytetrafluoroethylene or TEFLON®, AFLAS®; CHEMRAZ®, etc.), a biopolymer, a ductile metal (e.g., brass, aluminum, ductile steel, etc.), a degradable version of any of the foregoing, or any combination thereof.

The wellbore isolation device 166 also includes an upper slip wedge 206*a* and a lower slip wedge 206*b* arranged about the mandrel 202 and positioned on opposing axial ends of the sealing element 204. As described below, the upper and lower slip wedges 206*a,b* are configured to cooperatively compress the sealing element 204 axially during actuation of the wellbore isolation device 116, and thereby force the sealing element 204 to expand radially outward to seal against the inner wall of the casing 114.

A set of upper slip segments 208*a* may be circumferentially disposed about the mandrel 202 adjacent the upper slip wedge 206*a*, and a set of lower slip segments 208*b* may be circumferentially disposed about the mandrel 202 adjacent the lower slip wedge 206*b*. The upper and lower slip wedges 206*a,b* may be initially positioned in a slidable relationship to, and partially underneath, the corresponding sets of upper and lower slip segments 208*a,b*. As shown in FIG. 2A, one or more slip retaining bands 210 (two shown) may be used to help radially retain the upper and lower slip segments 208*a,b* in an initial circumferential position about the mandrel 202 and corresponding upper and lower slip wedge 206*a,b*. The retaining bands 210 may be made of a material having sufficient strength to hold the upper and lower slip segments 208*a,b* in the initial circumferential position prior to actuating the wellbore isolation device 116. Suitable materials for the retaining bands 210 may include, but are not limited to, a metal wire (e.g., steel, aluminum, brass, etc.), a plastic, a composite material, or any combination thereof. The retaining bands 210 may be carried in corresponding grooves 214 (best seen in FIG. 2B) defined on the outer radial surface of the upper and lower slip segments 208*a,b*. While two retaining bands 210 are depicted as used with each set of upper and lower slip segments 208*a,b*, it will be appreciated that more or less than two retaining bands 210 may be employed, without departing from the scope of the disclosure.

Each segment of the upper and lower slip segments 208*a,b* may include one or more gripping devices 216 used to engage and grippingly engage the inner wall of the casing 114, or alternatively to sealingly engage the inner wall of the wellbore 106 (FIG. 1) or another type of wellbore pipe disposable within the wellbore 106. In the illustrated embodiment, the gripping devices 216 are depicted as discs made of a hard or ultra-hard material, such as ceramic, tungsten carbide, or synthetic diamond. The discs may be coupled to or otherwise embedded within the outer surface of the corresponding upper and lower slip segments 208*a,b*. In other embodiments, however, the gripping devices 216 may alternatively comprise a series of teeth or serrated edges defined on the outer radial surface of the upper and lower slip segments 208*a,b*.

The wellbore isolation device 116 may further include a spacer ring 218 and a bullnose 220 (alternately referred to as a "shoe" or a "mule shoe"). As illustrated, the spacer ring 218 may be positioned at or near the first end 203*a* and provides an abutment that axially retains the set of upper slip segments 208*a* in place. The bullnose 220 may be provided at or near the second end 203*b* and may be configured to engage the downhole end of the set of lower slip segments 208*b* upon actuating the wellbore isolation device 116. In some embodiments, the bullnose 220 may be coupled to the mandrel 202 at the second end 203*b*, but could alternatively form an integral part of the mandrel 202, such as comprising an increased diameter portion of the mandrel 202. Moreover, in some embodiments, the bullnose 220 may be replaced with a muleshoe or similar device, as known to those skilled in the art.

Exemplary operation of the wellbore isolation device 116 is now provided. As discussed above, the wellbore isolation device 116 (e.g., a frac plug or a casing internal packer) may be conveyed into the wellbore 106 (FIG. 1) on the conveyance 118 (FIG. 1) in its unset configuration, as shown in FIG.

2A. In some embodiments, as shown in FIG. 2B, the wellbore 106 may be lined with casing 114 or another type of wellbore pipe. Alternatively, the wellbore 106 may be uncompleted (alternately referred to as "open hole") and the wellbore isolation device 116 may instead be configured to seal against the inner wall of the wellbore 106 itself. The wellbore isolation device 116 may be conveyed downhole to a target location and, once reaching the target location, the wellbore isolation device 116 may be actuated to the set configuration, as shown in FIG. 2B.

In some embodiments, for example, a setting tool (not shown) of a type known in the art may be coupled to the first end 203*a* of the wellbore isolation device 116 and utilized to actuate the wellbore isolation device 116 to the set configuration. The setting tool may operate via various mechanisms including, but not limited to, hydraulic setting, mechanical setting, setting by swelling, setting by inflation, and the like. In other embodiments, however, a wellbore projectile (e.g., a ball, a plug, a dart, etc.) may be dropped into the wellbore and pumped to the wellbore isolation device 116. Once reaching the wellbore isolation device 116, the wellbore isolation device may land on a corresponding seat and thereby allow the interior of the wellbore isolation device 116 to be pressurized and thereby actuate the wellbore isolation device 116 to the set configuration.

In actuating the wellbore isolation device 116 to the set position, the mandrel 202 may be moved in the uphole direction (i.e., to the left in FIGS. 2A and 2B) and thereby correspondingly drawing the bullnose 220 in the uphole direction. As the bullnose 220 moves axially uphole, it engages the set of lower slip segments 208*b* and forces them axially toward the set of upper slip segments 208*a*, which abut against the spacer ring 218 on the uphole end. The spacer ring 218 remains stationary while the mandrel 202 and the bullnose 220 are drawn upwards by the setting tool. Continued axial movement of the bullnose 220 in the uphole direction forces the sets of upper and lower slip segments 208*a,b* against the corresponding upper and lower slip wedges 206*a,b*, which are thereby forced to move axially toward each other As the upper and lower slip segments 208*a,b* translate axially toward each other, each slidingly engages outer ramped surfaces 222*a* and 222*b* (FIG. 2A) of the corresponding upper and lower slip wedges 206*a,b* and thereby radially expand toward the inner wall of the casing 114. As the sets of upper and lower slip segments 208*a,b* radially expand, the slip retaining bands 210 either flex (stretch) to accommodate the radial expansion or otherwise fail under the increased tension. Moreover, radially expanding the upper and lower slip segments 208*a,b* allows the gripping devices 216 to contact and grippingly engage (also referred to as "bite") the inner surface of the casing 114, which prevents the upper and lower slip wedges 206*a,b* from subsequently moving in opposing directions away from each other. As the upper and lower slip wedges 206*a,b* move axially toward each other, the sealing element 204 is axially compressed, which results in its radial expansion and sealing engagement with the inner surface of the casing 114. With the gripping devices 216 engaged on the inner surface of the casing 114, the sealing element 204 is prevented from radially contracting, but instead provides a point of fluid isolation within the casing 114.

At sufficiently high pressure and temperature conditions, the material used to form the sealing element 204 may tend to creep or extrude into adjacent gaps or spaces. More particularly, the material of the sealing element 204 may creep into a radial gap 224 (FIG. 2B) formed between the inner wall of the casing 114 and an outer radial surface 228 of one or both of the slip wedges 206*a,b*. Moreover, the material of the sealing element 204 may also extrude between angularly adjacent slip segments 208*a,b* into axial gaps 226 (FIG. 2B) formed as the slip segments 208*a,b* radially expand. Creep or extrusion of the material of the sealing element 204 into one or both of the radial and axial gaps 224, 226 can damage the sealing element 204 and could thereby result in leakage of well fluids past the wellbore isolation device 116 within the casing 114.

According to embodiments of the present disclosure, the wellbore isolation device 116 may further include one or more extrusion limiting rings 230 (one shown) configured to resist such material extrusion. In the illustrated embodiment, the extrusion limiting ring 230 is depicted as being positioned adjacent the lower slip wedge 206*b* and the lower slip segments 208*b*. In other embodiments, however, the extrusion limiting ring 230 may alternatively be used adjacent the upper slip wedge 206*a* and the upper slip segments 208*a*. In yet other embodiments, the wellbore isolation device 116 may include two extrusion limiting rings 230, each being positioned adjacent corresponding upper and lower slip wedges 206*a,b* and corresponding sets of upper and lower slip segments 208*a,b*, without departing from the scope of the disclosure.

The extrusion limiting ring 230 may be configured to move between a contracted state, as shown in FIG. 2A, and an expanded state, as shown in FIG. 2B. Briefly, the extrusion limiting ring 230 may be moved to the expanded state as the sealing element 204 radially expands. More particularly, in the contracted state, the extrusion limiting ring 230 is disposed about a reduced-diameter portion of the sealing element 204. As the sealing element 204 radially expands, the extrusion limiting ring 230 correspondingly expands to the expanded state, which allows the extrusion limiting ring 230 to detach from the reduced-diameter portion of the sealing element 204 and land on (slip or slide onto) the outer radial surface 228 of the lower slip wedge 206*b*. As seated about the outer radial surface 228, the extrusion limiting ring 230 may be configured to mitigate or prevent extrusion of the material of the sealing element 204 into the radial and axial gaps 224, 226.

Figure 3A:
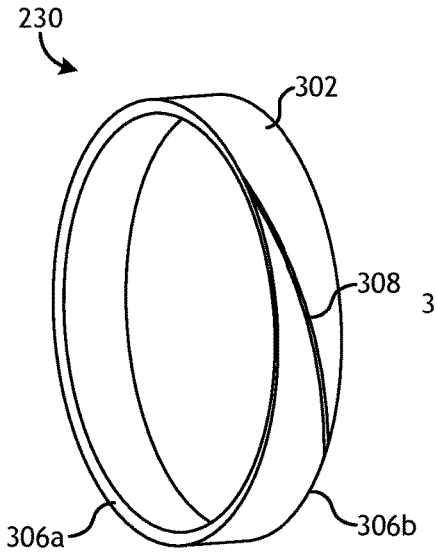
FIGS. 3A-3C are various views of an exemplary embodiment of the extrusion limiting ring of FIG. 2.
Figure 3B:
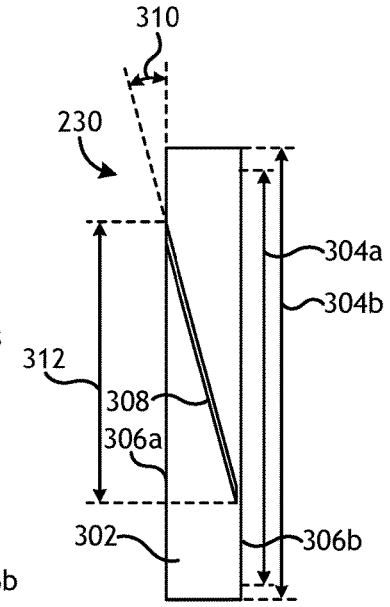
Figure 3C:
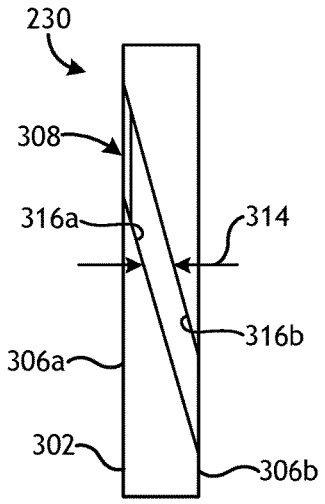

FIGS. 3A-3C are various views of an exemplary embodiment of the extrusion limiting ring 230 of FIGS. 2A-2B, according to one or more embodiments. More specifically, FIG. 3A is an isometric view of the extrusion limiting ring 230, FIG. 3B is a side view of the extrusion limiting ring 230 in the contracted state, and FIG. 3C is a side view of the extrusion limiting ring 230 in the expanded state. As illustrated, the extrusion limiting ring 230 includes a generally annular body 302 that provides an inner diameter 304*a* (FIG. 3B), an outer diameter 304*b* (FIG. 3B), a first axial end 306*a*, and a second axial end 306*b*.

A scarf cut 308 is defined in the body 302 and extends at least partially between the first and second axial ends 306*a,b*. The scarf cut 308 can be created by a variety of methods, including electrical discharge machining (EDM), sawing, milling, turning, or by any other machining techniques that result in the formation of a slit through the annular body 302. The scarf cut 308 may extend between the first and second axial ends 306*a,b* at an angle 310 (FIG. 3B) relative to one of the first and second axial ends 306*a,b*. In the illustrated embodiment, the angle 310 of the scarf cut 308 is defined in the body 302 relative to the first axial end 306*a*. In some embodiments, the angle 310 of the scarf cut 308 may be about 10°, about 15°, or about 20°. In other embodiments, however, the angle 310 of the scarf cut 308 may be about 40°, about 45°, or about 50°. As the angle 310 of the scarf cut 308 decreases, a circumferential length 312 (FIG. 3B) of the scarf cut 308 correspondingly increases. A greater circumferential length 312 of the scarf cut 308 advantageously enables a larger expansion potential of the extrusion limiting ring 230 without the extrusion limiting ring 230 completely separating when viewed from an axial perspective.

The scarf cut 308 permits radial expansion of the extrusion limiting ring 230 to the expanded state as the sealing element 204 (FIGS. 2A-2B) radially expands. In the expanded state, as shown in FIG. 3C, a gap 314 may be formed between opposing angled surfaces 316*a* and 316*b* of the scarf cut 308. The angle 310 of the scarf cut 308 may be calculated such that when the extrusion limiting ring 230 moves to the expanded state, the opposing angled surfaces 316*a,b* of the scarf cut 308 axially overlap to at least a small degree such that no axial gaps are created between the first and second axial ends 306*a,b*. Accordingly, the scarf cut 308 enables the extrusion limiting ring 230 to separate at the opposing angled surfaces 316*a,b* and thereby enable a degree of freedom that permits expansion and contraction of the extrusion limiting ring 230 during operation.

The extrusion limiting ring 230 may be made of a variety of materials such as, but not limited to, a metal, a polymer, a composite material, and any combination thereof. Suitable metals that may be used for the extrusion limiting ring 230 include steel, brass, aluminum, magnesium, iron, cast iron, tungsten, tin, and any alloys thereof. Suitable composite materials that may be used for the extrusion limiting ring 230 include materials including fibers (chopped, woven, etc.) dispersed in a phenolic resin, such as fiberglass and carbon fiber materials.

In some embodiments, the extrusion limiting ring 230 may be made of a degradable or dissolvable material. As used herein, the term "degradable" and all of its grammatical variants (e.g., "degrade," "degradation," "degrading," "dissolve," "dissolving," and the like), refers to the dissolution or chemical conversion of solid materials such that reduced-mass solid end products by at least one of solubilization, hydrolytic degradation, biologically formed entities (e.g., bacteria or enzymes), chemical reactions (including electrochemical and galvanic reactions), thermal reactions, reactions induced by radiation, or combinations thereof. In complete degradation, no solid end products result. In some instances, the degradation of the material may be sufficient for the mechanical properties of the material to be reduced to a point that the material no longer maintains its integrity and, in essence, falls apart or sloughs off into its surroundings. The conditions for degradation are generally wellbore conditions where an external stimulus may be used to initiate or effect the rate of degradation, where the external stimulus is naturally occurring in the wellbore (e.g., pressure, temperature, etc.) or introduced into the wellbore (e.g., fluids, chemicals, etc.). For example, the pH of the fluid that interacts with the material may be changed by introduction of an acid or a base. The term "wellbore environment" includes both naturally occurring wellbore environments and materials or fluids introduced into the wellbore.

Suitable degradable materials that may be used in accordance with the embodiments of the present disclosure include borate glass, polyglycolic acid (PGA), polylactic acid (PLA), a degradable rubber, a degradable polymer, a galvanically-corrodible metal, a dissolvable metal, a dehydrated salt, and any combination thereof. The degradable materials may be configured to degrade by a number of mechanisms including, but not limited to, swelling, dissolving, undergoing a chemical change, electrochemical reactions, undergoing thermal degradation, or any combination of the foregoing.

Degradation by swelling involves the absorption by the degradable material of aqueous fluids or hydrocarbon fluids present within the wellbore environment such that the mechanical properties of the degradable material degrade or fail. Exemplary hydrocarbon fluids that may swell and degrade the degradable material include, but are not limited to, crude oil, a fractional distillate of crude oil, a saturated hydrocarbon, an unsaturated hydrocarbon, a branched hydrocarbon, a cyclic hydrocarbon, and any combination thereof. Exemplary aqueous fluids that may swell to degrade the degradable material include, but are not limited to, fresh water, saltwater (e.g., water containing one or more salts dissolved therein), brine (e.g., saturated salt water), seawater, acid, bases, or combinations thereof. In degradation by swelling, the degradable material continues to absorb the aqueous and/or hydrocarbon fluid until its mechanical properties are no longer capable of maintaining the integrity of the degradable material and it at least partially falls apart. In some embodiments, the degradable material may be designed to only partially degrade by swelling in order to ensure that the mechanical properties of the extrusion limiting ring 230 formed from the degradable material is sufficiently capable of lasting for the duration of the specific operation in which it is utilized.

Degradation by dissolving involves a degradable material that is soluble or otherwise susceptible to an aqueous fluid or a hydrocarbon fluid, such that the aqueous or hydrocarbon fluid is not necessarily incorporated into the degradable material (as is the case with degradation by swelling), but becomes soluble upon contact with the aqueous or hydrocarbon fluid.

Degradation by undergoing a chemical change may involve breaking the bonds of the backbone of the degradable material (e.g., a polymer backbone) or causing the bonds of the degradable material to crosslink, such that the degradable material becomes brittle and breaks into small pieces upon contact with even small forces expected in the wellbore environment.

Thermal degradation of the degradable material involves a chemical decomposition due to heat, such as the heat present in a wellbore environment. Thermal degradation of some degradable materials mentioned or contemplated herein may occur at wellbore environment temperatures that exceed about 93° C. (or about 200° F.).

With respect to degradable polymers used as a degradable material, a polymer is considered to be "degradable" if the degradation is due to, in situ, a chemical and/or radical process such as hydrolysis, oxidation, or UV radiation. Degradable polymers, which may be either natural or synthetic polymers, include, but are not limited to, polyacrylics, polyamides, and polyolefins such as polyethylene, polypropylene, polyisobutylene, and polystyrene. Suitable examples of degradable polymers that may be used in accordance with the embodiments of the present invention include polysaccharides such as dextran or cellulose, chitins, chitosans, proteins, aliphatic polyesters, poly(lactides), poly(glycolides), poly(?-caprolactones), poly(hydroxybutyrates), poly(anhydrides), aliphatic or aromatic polycarbonates, poly (orthoesters), poly(amino acids), poly(ethylene oxides), polyphosphazenes, poly(phenyllactides), polyepichlorohydrins, copolymers of ethylene oxide/polyepichlorohydrin, terpolymers of epichlorohydrin/ethylene oxide/allyl glycidyl ether, and any combination thereof. Of these degradable polymers, as mentioned above, polyglycolic acid and polylactic acid may be preferred. Polyglycolic acid and polylactic acid tend to degrade by hydrolysis as the temperature increases.

Polyanhydrides are another type of particularly suitable degradable polymer useful in the embodiments of the present disclosure. Polyanhydride hydrolysis proceeds, in situ, via free carboxylic acid chain-ends to yield carboxylic acids as final degradation products. The erosion time can be varied over a broad range of changes in the polymer backbone. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

Suitable degradable rubbers include degradable natural rubbers (i.e., cis-1,4-polyisoprene) and degradable synthetic rubbers, which may include, but are not limited to, ethylene propylene diene M-class rubber, isoprene rubber, isobutylene rubber, polyisobutene rubber, styrene-butadiene rubber, silicone rubber, ethylene propylene rubber, butyl rubber, norbornene rubber, polynorbornene rubber, a block polymer of styrene, a block polymer of styrene and butadiene, a block polymer of styrene and isoprene, and any combination thereof. Other suitable degradable polymers include those that have a melting point that is such that it will dissolve at the temperature of the subterranean formation in which it is placed.

In some embodiments, the degradable material may have a thermoplastic polymer embedded therein. The thermoplastic polymer may modify the strength, resiliency, or modulus of the extrusion limiting ring 230 and may also control the degradation rate of the extrusion limiting ring 230. Suitable thermoplastic polymers may include, but are not limited to, an acrylate (e.g., polymethylmethacrylate, polyoxymethylene, a polyamide, a polyolefin, an aliphatic polyamide, polybutylene terephthalate, polyethylene terephthalate, polycarbonate, polyester, polyethylene, polyetheretherketone, polypropylene, polystyrene, polyvinylidene chloride, styrene-acrylonitrile), polyurethane prepolymer, polystyrene, poly(o-methylstyrene), poly(m-methylstyrene), poly (p-methylstyrene), poly(2,4-dimethylstyrene), poly(2,5-dimethylstyrene), poly(p-tert-butylstyrene), poly(p-chlorostyrene), poly(?-methylstyrene), co- and ter-polymers of polystyrene, acrylic resin, cellulosic resin, polyvinyl toluene, and any combination thereof. Each of the foregoing may further comprise acrylonitrile, vinyl toluene, or methyl methacrylate. The amount of thermoplastic polymer that may be embedded in the degradable material forming the extrusion limiting ring 230 may be any amount that confers a desirable elasticity without affecting the desired amount of degradation. In some embodiments, the thermoplastic polymer may be included in an amount in the range of a lower limit of about 1%, 5%, 10%, 15%, 20%, 25%, 30%, 35%, 40%, and 45% to an upper limit of about 91%, 85%, 80%, 75%, 70%, 65%, 60%, 55%, 50%, and 45% by weight of the degradable material, encompassing any value or subset therebetween.

With respect to galvanically-corrodible metals used as a degradable material, the galvanically-corrodible metal may be configured to degrade via an electrochemical process in which the galvanically-corrodible metal corrodes in the presence of an electrolyte (e.g., brine or other salt-containing fluids present within the wellbore). Suitable galvanically-corrodible metals include, but are not limited to, gold, gold-platinum alloys, silver, nickel, nickel-copper alloys, nickel-chromium alloys, copper, copper alloys (e.g., brass, bronze, etc.), chromium, tin, aluminum, iron, zinc, magnesium, and beryllium. Suitable galvanically-corrodible metals also include a nano-structured matrix galvanic materials. One example of a nano-structured matrix micro-galvanic material is a magnesium alloy with iron-coated inclusions. Suitable galvanically-corrodible metals also include micro-galvanic metals or materials, such as a solution-structured galvanic material. An example of a solution-structured galvanic material is zirconium (Zr) containing a magnesium (Mg) alloy, where different domains within the alloy contain different percentages of Zr. This leads to a galvanic coupling between these different domains, which causes micro-galvanic corrosion and degradation. Micro-galvanically corrodible magnesium alloys could also be solution structured with other elements such as zinc, aluminum, nickel, iron, carbon, tin, silver, copper, titanium, rare earth elements, et cetera. Micro-galvanically corrodible aluminum alloys could be in solution with elements such as nickel, iron, carbon, tin, silver, copper, titanium, gallium, et cetera.

In some embodiments, blends of certain degradable materials may also be suitable as the degradable material for the extrusion limiting ring 230. One example of a suitable blend of degradable materials is a mixture of PLA and sodium borate where the mixing of an acid and base could result in a neutral solution where this is desirable. Another example may include a blend of PLA and boric oxide. The choice of blended degradable materials also can depend, at least in part, on the conditions of the well, e.g., wellbore temperature. For instance, lactides have been found to be suitable for lower temperature wells, including those within the range of 60° F. to 150° F., and PLAs have been found to be suitable for well bore temperatures above this range. In addition, PLA may be suitable for higher temperature wells. Some stereoisomers of poly(lactide) or mixtures of such stereoisomers may be suitable for even higher temperature applications. Dehydrated salts may also be suitable for higher temperature wells. Other blends of degradable materials may include materials that include different alloys including using the same elements but in different ratios or with a different arrangement of the same elements.

In some embodiments, the degradable material may include a material that has undergone different heat treatments and therefore exhibits varying grain structures or precipitation structures. As an example, in some magnesium alloys, the beta phase can cause accelerated corrosion if it occurs in isolated particles. Homogenization annealing for various times and temperatures causes the beta phase to occur in isolated particles or in a continuous network. In this way, the corrosion behavior can be very different for the same alloy with different heat treatments.

In some embodiments, the degradable material may be at least partially encapsulated in a second material or "sheath" disposed on all or a portion of the extrusion limiting ring 230. The sheath may be configured to help prolong degradation of the extrusion limiting ring 230. The sheath may also serve to protect the extrusion limiting ring 230 from abrasion within the wellbore. The sheath may be permeable, frangible, or comprise a material that is at least partially removable at a desired rate within the wellbore environment. In either scenario, the sheath may be designed such that it does not interfere with the ability of the wellbore isolation device 116 to form a fluid seal in the wellbore.

The sheath may comprise any of the afore-mentioned degradable materials. In some embodiments, the sheath may be made of a degradable material that degrades at a rate that is faster than that of the underlying degradable material that forms the extrusion limiting ring 230. Other suitable materials for the sheath include, but are not limited to, a TEF- LON® coating, a wax, a drying oil, a polyurethane, an epoxy, a crosslinked partially hydrolyzed polyacrylic, a silicate material, a glass, an inorganic durable material, a polymer, polylactic acid, polyvinyl alcohol, polyvinylidene chloride, a hydrophobic coating, paint, and any combination thereof.

In some embodiments, all or a portion of the outer surface of the extrusion limiting ring 230 may be treated to impede degradation. For example, the outer surface of the extrusion limiting ring 230 may undergo a treatment that aids in preventing the degradable material (e.g., a galvanically-corrodible metal) from galvanically-corroding. Suitable treatments include, but are not limited to, an anodizing treatment, an oxidation treatment, a chromate conversion treatment, a dichromate treatment, a fluoride anodizing treatment, a hard anodizing treatment, and any combination thereof. Some anodizing treatments may result in an anodized layer of material being deposited on the outer surface of the extrusion limiting ring 230. The anodized layer may comprise materials such as, but not limited to, ceramics, metals, polymers, epoxies, elastomers, or any combination thereof and may be applied using any suitable processes known to those of skill in the art. Examples of suitable processes that result in an anodized layer include, but are not limited to, soft anodize coating, anodized coating, electroless nickel plating, hard anodized coating, ceramic coatings, carbide beads coating, plastic coating, thermal spray coating, high velocity oxygen fuel (HVOF) coating, a nano HVOF coating, a metallic coating.

In some embodiments, all or a portion of the outer surface of the extrusion limiting ring 230 may be treated or coated with a substance configured to enhance degradation of the degradable material. For example, such a treatment or coating may be configured to remove a protective coating or treatment or otherwise accelerate the degradation of the degradable material of the extrusion limiting ring 230. An example is a galvanically-corroding metal material coated with a layer of PGA. In this example, the PGA would undergo hydrolysis and cause the surrounding fluid to become more acidic, which would accelerate the degradation of the underlying metal.

In some embodiments, the degradable material may be made of dissimilar metals that generate a galvanic coupling that either accelerates or decelerates the degradation rate of the extrusion limiting ring 230. As will be appreciated, such embodiments may depend on where the dissimilar metals lie on the galvanic potential. In at least one embodiment, a galvanic coupling may be generated by embedding a cathodic substance or piece of material into an anodic structural element. For instance, the galvanic coupling may be generated by dissolving aluminum in gallium. A galvanic coupling may also be generated by using a sacrificial anode coupled to the degradable material. In such embodiments, the degradation rate of the degradable material may be decelerated until the sacrificial anode is dissolved or otherwise corroded away.

Figure 4:
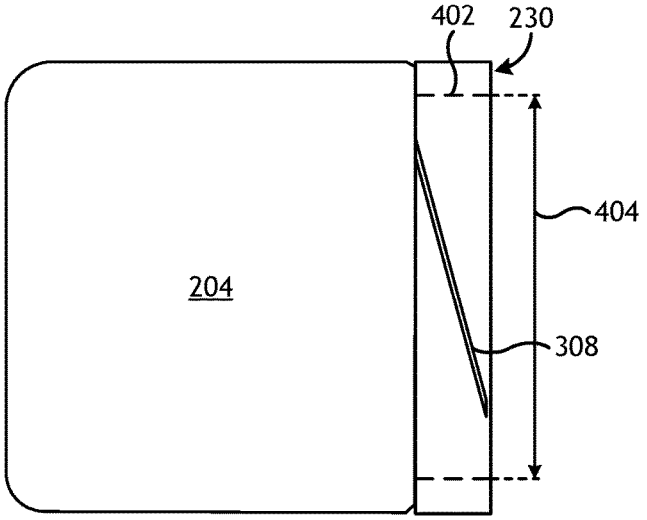
FIG. 4 is a side view of the extrusion limiting ring positioned about a portion of the sealing element.

FIG. 4 is a side view of the extrusion limiting ring 230 as positioned about a portion of the sealing element 204, according to one or more embodiments. In the illustrated embodiment, the extrusion limiting ring 230 may be positioned about a radial shoulder 402 defined on an axial end of the sealing element 204. The radial shoulder 402 may comprise a reduced diameter portion of the sealing element 204, where a diameter 404 of the radial shoulder 402 may be the same as or slightly larger than the inner diameter 304*a* (FIG. 3B) of the extrusion limiting ring 230 while in the contracted state.

In some embodiments, the extrusion limiting ring 230 may be extended over (around) the radial shoulder 402 while assembling the wellbore isolation device 116 (FIGS. 2A-2B). In such embodiments, the extrusion limiting ring 230 in the contracted state 230 may exhibit sufficient radial compressive force to remain seated on the radial shoulder 402 until expanded radially outward when the sealing element 204 expands.

In other embodiments, however, the extrusion limiting ring 230 may be secured about the sealing element 204 at the radial shoulder 402 while molding or otherwise forming the sealing element 204. In such embodiments, the extrusion limiting ring 230 may be bonded to the material of the sealing element 204 after the sealing element 204 has been molded. The combined sealing element 204 and extrusion limiting ring 230 may then be jointly assembled on the mandrel 202 (FIGS. 2A-2B) of the wellbore isolation device 116 (FIGS. 2A-2B). Molding the extrusion limiting ring 230 directly to the sealing element 204 at the radial shoulder 402 helps retain the extrusion limiting ring 230 in the contracted state until it is to be expanded, and thereby prevents the extrusion limiting ring 230 from expanding prematurely. This may also prove advantageous in facilitating easier manufacturing of the wellbore isolation device 116.

Referring again to FIGS. 2A and 2B, exemplary operation of the extrusion limiting ring 230 in conjunction with the wellbore isolation device 116 is now provided. The wellbore isolation device 116 is run into the wellbore 106 (FIG. 1) with the extrusion limiting ring 230 in the contracted configuration, as shown in FIG. 2A. Upon reaching the target location within the wellbore 106, the wellbore isolation device 116 may be actuated to the set configuration, as described above, which radially expands the sealing element 204 into sealing engagement with the inner surface of the casing 114. As the sealing element 204 radially expands, the radial shoulder 402 (FIG. 4) also radially expands, which forces the extrusion limiting ring 230 to correspondingly expand from the contracted state to the expanded state, as shown in FIG. 2B.

Moving the extrusion limiting ring 230 to the expanded state gradually increases the size of the scarf cut 308 as the diameter increases and allows the extrusion limiting ring 230 to break free from the sealing element 204. Eventually, the diameter of the extrusion limiting ring 230 will be large enough to extend over the outer radial surface of the lower slip wedge 206*b* and otherwise enter into the radial gap 224 formed between the inner wall of the casing 114 and the outer radial surface 228 of the lower slip wedge 206*b*. As positioned about the outer radial surface 228 of the lower slip wedge 206*b*, the extrusion limiting ring 230 may operate to prevent or hinder the material used to form the sealing element 204 from creeping or extruding into the radial gap 224 and the axial gaps 226 formed between angularly adjacent lower slip segments 208*b*. Rather, the extrusion limiting ring 230 in the expanded state forms an axial and/or radial barrier to the material of the sealing element 204. In some cases, the extrusion gap for the sealing element 204 may be reduced but not totally eliminated through use of the extrusion limiting ring 230. In such cases, the sealing element 204 may extrude a small amount, but still hold the desired pressure without extruding to a point of failure. Moreover, in the expanded stated, the extrusion limiting ring 230 may engage the uphole end of the set of lower slip segments 208*b*, which may axially reinforce the extrusion limiting ring 230 as the material of the sealing element 204 creeps and engages the extrusion limiting ring 230. As will be appreciated, the same may also be true if the extrusion limiting ring 230 were used on the opposite side of the sealing element 204, where the extrusion limiting ring 230 would engage the downhole end of the set of upper slip segments 208*a*.

Figure 5:
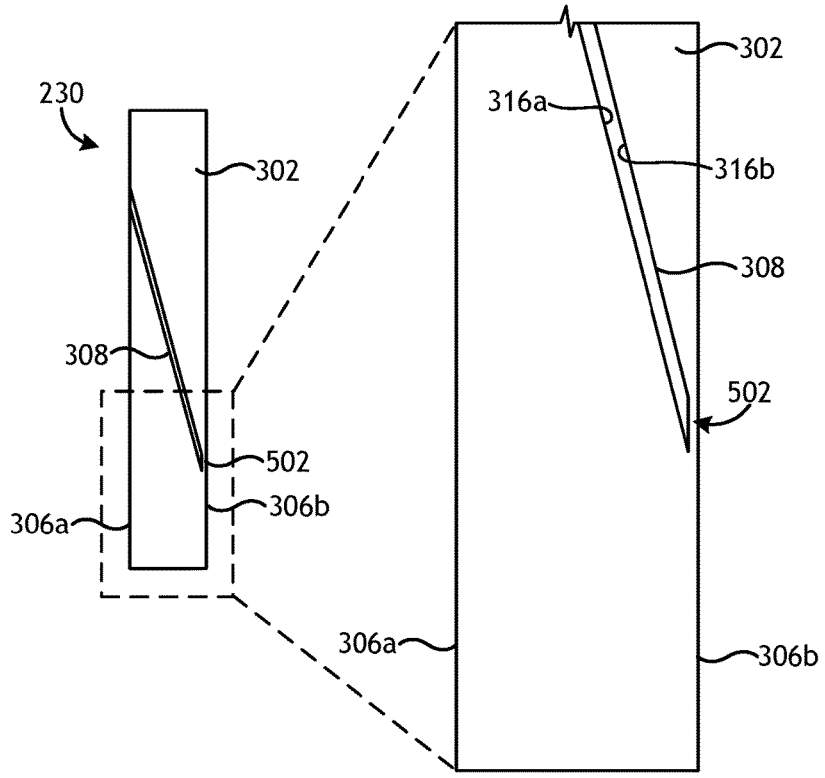
FIG. 5 is a side view of another embodiment of the extrusion limiting ring of FIG. 2.

FIG. 5 is a side view of another embodiment of the extrusion limiting ring 230, according to one or more additional embodiments. In some embodiments, the extrusion limiting ring 230 may be retained in the contracted state using a retaining means and will only be moved to the expanded state upon overcoming the retention force of the retaining means. In FIG. 5, for example, the extrusion limiting ring 230 may be retained in the contracted state with an amount of material 502 remaining in the scarf cut 308. More particularly, the scarf cut 308 defined in the annular body 302 may not extend entirely through the body 302 between the first and second axial ends 306*a,b*. Rather, the scarf cut 308 may be stopped short such that a small amount of the material 502 of the extrusion limiting ring 230 may remain. The remaining material 502 may prevent the extrusion limiting ring 230 from expanding. Instead, the material 502 must first be sheared or otherwise fail before the extrusion limiting ring 230 can move to the expanded state. In some embodiments, radial expansion of the sealing element 204 (FIGS. 2A-2B) may serve to shear the remaining material 502 so that the opposing angled surfaces 318*a,b* may separate and the extrusion limiting ring 230 may move to the expanded state.

Figure 6A:
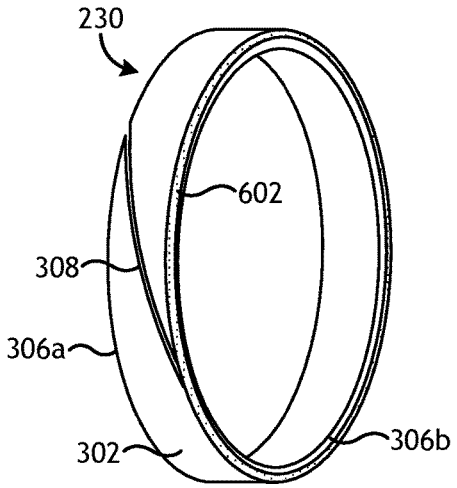
FIGS. 6A and 6B are isometric and cross-sectional side views, respectively, of yet another embodiment of the extrusion limiting ring of FIG. 2.
Figure 6B:
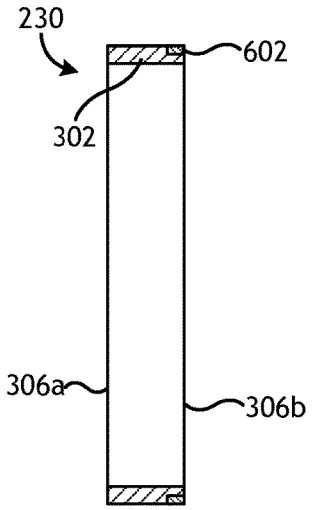

FIGS. 6A and 6B are isometric and cross-sectional side views, respectively, of yet another embodiment of the extrusion limiting ring 230, according to one or more additional embodiments. The extrusion limiting ring 230 of FIGS. 6A and 6B may be retained in the contracted state using another retaining means, namely, a frangible member 602 that extends circumferentially across a portion of the scarf cut 308. In some embodiments, as shown in FIG. 6A, the frangible member 602 may be an annular ring that extends about the entire circumference of the body 302, including across a portion of the scarf cut 308. In other embodiments, however, the frangible member 602 may extend only partially about the circumference of the body 302, but nonetheless across a portion of the scarf cut 308.

As shown in FIG. 6B, the frangible member 602 may be arranged within a groove 604 defined on the outer radial surface of the body 302. In some embodiments, as illustrated, the groove 604 may be defined at or near the second axial end 306*b* of the body 302. In other embodiments, however, the groove 604 may be defined on the body 302 at any point between the first and second axial ends 306*a,b*, without departing from the scope of the disclosure.

The frangible member 602 may be made of a variety of materials configured to yield upon assuming a radial force, such as when the sealing element 204 (FIGS. 2A-2B) radially expands and forces the extrusion limiting ring 230 to correspondingly expand. Suitable materials for the frangible member 602 include, but are not limited to, a composite material (e.g., fiberglass, carbon fiber, etc.), a plastic, rubber, an elastomer, a metal, any of the degradable materials mentioned herein, and any combination thereof. Similar to the remaining material 502 of FIG. 5, the frangible member 602 must first be sheared or otherwise fail before the extrusion limiting ring 230 can move to the expanded state, thereby preventing premature expansion of the extrusion limiting ring 230.

Figure 7:
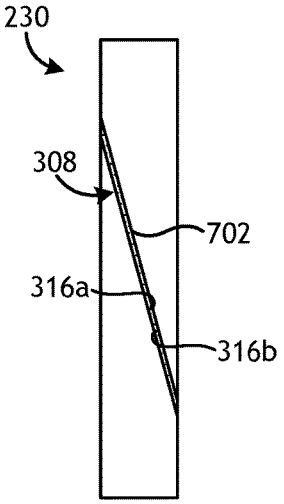
FIG. 7 is a side view of another embodiment of the extrusion limiting ring of FIG. 2.

FIG. 7 is a side view of another embodiment of the extrusion limiting ring 230, according to one or more additional embodiments. The extrusion limiting ring 230 of FIG. 7 may be retained in the contracted state using another retaining means, namely, a bonding material 702 disposed within all or a portion of the scarf cut 308. The bonding material 702 may be configured to couple the opposing angled surfaces 316*a,b* together and must be sheared or otherwise fail before the extrusion limiting ring 230 can move to the expanded state, which prevents premature expansion of the extrusion limiting ring 230.

The bonding material 702 may comprise any material or substance applied to and otherwise deposited in the scarf cut 308 to prevent separation of the opposing angled surfaces 316*a,b* until the extrusion limiting ring 230 assumes the radial force sufficient to move the extrusion limiting ring 230 to the expanded state. Suitable materials that may be used as the bonding material 702 include, but are not limited to, a glue (e.g., weld glue, an industrial adhesive, etc.), an epoxy, a weld bead, braze, and any combination thereof.

Embodiments disclosed herein include:

A. A wellbore isolation device that includes an elongate mandrel, a sealing element carried by the mandrel, a slip wedge positioned about the mandrel axially adjacent the sealing element and providing an outer radial surface, a set of slip segments circumferentially disposed about the mandrel and at least a portion of the slip wedge, and an extrusion limiting ring having an annular body that provides a first axial end, a second axial end, and a scarf cut extending at least partially between the first and second axial ends, wherein the extrusion limiting ring is movable between a contracted state, where the extrusion limiting ring is disposed about the sealing element, and an expanded state, where the extrusion limiting ring is disposed about the outer radial surface of the lower slip wedge.

B. A method that includes conveying a wellbore isolation device to a location within a wellbore, the wellbore isolation device including an elongate mandrel, a sealing element carried by the mandrel, a slip wedge positioned about the mandrel axially adjacent the sealing element, a set of slip segments circumferentially disposed about the mandrel and at least a portion of the slip wedge, and an extrusion limiting ring disposed about the sealing element and having an annular body that provides a first axial end, a second axial end, and a scarf cut extending at least partially between the first and second axial ends. The method further including actuating the wellbore isolation device and thereby radially expanding the sealing element to seal the wellbore at the location, wherein radially expanding the sealing element moves the extrusion limiting ring from a contracted state disposed about the sealing element to an expanded state, where the extrusion limiting ring is disposed about an outer radial surface of the lower slip wedge, and preventing with the extrusion limiting ring a material of the sealing element from extruding axially across the outer radial surface and into axial gaps formed between angularly adjacent slip segments of the set of slip segments.

C. A well system that includes a wellbore, and a wellbore isolation device conveyable within the wellbore and including an elongate mandrel, a sealing element carried by the mandrel, a slip wedge positioned about the mandrel axially adjacent the sealing element and providing an outer radial surface, a set of slip segments circumferentially disposed about the mandrel and at least a portion of the slip wedge, an extrusion limiting ring having an annular body that provides a first axial end, a second axial end, and a scarf cut extending at least partially between the first and second axial ends, wherein the extrusion limiting ring is movable between a contracted state, where the extrusion limiting ring is disposed about the sealing element, and an expanded state, where the extrusion limiting ring is disposed about the outer radial surface of the lower slip wedge.

Each of embodiments A, B, and C may have one or more of the following additional elements in any combination: Element 1: wherein the scarf cut is defined in the annular body at an angle relative to one of the first and second axial ends, and wherein the angle is offset from perpendicular to the one of the first and second axial ends. Element 2: wherein the extrusion limiting ring comprises a material selected from the group consisting of a metal, a polymer, a composite material, a degradable material, and any combination thereof. Element 3: wherein the degradable material is selected from the group consisting of borate glass, polyglycolic acid, polylactic acid, a degradable rubber, a degradable polymer, a galvanically-corrodible metal, a dissolvable metal, a dehydrated salt, and any combination thereof. Element 4: wherein a radial shoulder is defined on an axial end of the sealing element and the extrusion limiting ring is positioned about the sealing element on the radial shoulder in the contracted state. Element 5: wherein the extrusion limiting ring is bonded to the radial shoulder while forming the sealing element. Element 6: wherein the scarf cut provides opposing angled surfaces and an amount of material of the extrusion limiting ring connects the opposing angled surfaces in the contracted state. Element 7: further comprising a frangible member extending circumferentially across a portion of the scarf cut to maintain the extrusion limiting ring in the contracted state. Element 8: wherein the frangible member is arranged within a groove defined on an outer radial surface of the annular body. Element 9: wherein the scarf cut provides opposing angled surfaces and a bonding material is disposed within at least a portion of the scarf cut to couple the opposing angled surfaces in the contracted state.

Element 10: wherein the wellbore isolation device is selected from the group consisting of a frac plug, a bridge plug, a wellbore packer, a wiper plug, a cement plug, a sliding sleeve, and any combination thereof. Element 11: wherein actuating the wellbore isolation device to radially expand the sealing element comprises radially expanding the extrusion limiting ring as the sealing element radially expands. Element 12: wherein a radial shoulder is defined on an axial end of the sealing element and the extrusion limiting ring is positioned about the sealing element on the radial shoulder in the contracted state, and wherein radially expanding the sealing element comprises radially expanding the extrusion limiting ring and thereby enlarging a gap of the scarf cut. Element 13: wherein the extrusion limiting ring is bonded to the radial shoulder while forming the sealing element, the method further comprising breaking the extrusion limiting ring free from the radial shoulder as the sealing element radially expands. Element 14: wherein the scarf cut provides opposing angled surfaces and an amount of material of the extrusion limiting ring connects the opposing angled surfaces in the contracted state, the method further comprising radially expanding the extrusion limiting ring as the sealing element radially expands, and breaking the amount of material as the extrusion limiting ring radially expands and thereby allowing the opposing angled surfaces to separate. Element 15: wherein a frangible member extends circumferentially across a portion of the scarf cut to maintain the extrusion limiting ring in the contracted state, the method further comprising radially expanding the extrusion limiting ring as the sealing element radially expands, and breaking the frangible member as the extrusion limiting ring radially expands. Element 16: wherein the scarf cut provides opposing angled surfaces and a bonding material is disposed within at least a portion of the scarf cut to couple the opposing angled surfaces in the contracted state, the method further comprising radially expanding the extrusion limiting ring as the sealing element radially expands, and breaking the bonding material as the extrusion limiting ring radially expands and thereby allowing the opposing angled surfaces to separate.

Element 17: wherein a radial shoulder is defined on an axial end of the sealing element and the extrusion limiting ring is positioned about the sealing element on the radial shoulder in the contracted state. Element 18: wherein the scarf cut provides opposing angled surfaces coupled together in the contracted state with at least one of an amount of material of the extrusion limiting ring, a frangible member extending circumferentially across a portion of the scarf cut, and a bonding material is disposed within at least a portion of the scarf cut to couple the opposing angled surfaces in the contracted state.

By way of non-limiting example, exemplary combinations applicable to A, B, and C include: Element 2 with Element 3; Element 4 with Element 5; Element 7 with Element 8; and Element 12 with Element 13.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A wellbore isolation device, comprising:

an elongate mandrel;

a sealing element carried by the elongate mandrel;

a slip wedge positioned about the elongate mandrel axially adjacent the sealing element and providing an outer radial surface;

a set of slip segments circumferentially disposed about the elongate mandrel and at least a portion of the slip wedge; and an extrusion limiting ring having an annular body that provides a first axial end, a second axial end, and a scarf cut extending at least partially between the first and second axial ends, wherein the extrusion limiting ring is movable between a contracted state, where the extrusion limiting ring is disposed about the sealing element, and an expanded state, where the extrusion limiting ring is disposed about the outer radial surface of the slip wedge;

wherein the scarf cut provides opposing angled surfaces coupled together in the contracted state with a frangible bond.

2. The wellbore isolation device of claim 1, wherein the scarf cut is defined in the annular body at an angle relative to one of the first and second axial ends, and wherein the angle is offset from perpendicular to the one of the first and second axial ends.

3. The wellbore isolation device of claim 1, wherein the extrusion limiting ring comprises a material selected from the group consisting of a metal, a polymer, a composite material, a degradable material, and any combination thereof.

4. The wellbore isolation device of claim 1, wherein the extrusion limiting ring comprises a degradable material selected from the group consisting of borate glass, polyglycolic acid, polylactic acid, a degradable rubber, a degradable polymer, a galvanically-corrodible metal, a dissolvable metal, a dehydrated salt, and any combination thereof.

5. The wellbore isolation device of claim 1, wherein a radial shoulder is defined on an axial end of the sealing element and the extrusion limiting ring is positioned about the sealing element on the radial shoulder in the contracted state.

6. The wellbore isolation device of claim 5, wherein the extrusion limiting ring is bonded to the radial shoulder while forming the sealing element.

7. The wellbore isolation device of claim 1, wherein the frangible bond extends circumferentially across a portion of the scarf cut to maintain the extrusion limiting ring in the contracted state.

8. The wellbore isolation device of claim 7, wherein the frangible bond is arranged within a groove defined on an outer radial surface of the annular body.

9. The wellbore isolation device of claim 1, wherein the frangible bond is disposed within at least a portion of the scarf cut to couple the opposing angled surfaces in the contracted state.

10. A method, comprising:

conveying a wellbore isolation device to a location within a wellbore, the wellbore isolation device including:

an elongate mandrel;

a sealing element carried by the elongate mandrel;

a slip wedge positioned about the elongate mandrel axially adjacent the sealing element;

a set of slip segments circumferentially disposed about the elongate mandrel and at least a portion of the slip wedge; and an extrusion limiting ring disposed about the sealing element and having an annular body that provides a first axial end, a second axial end, and a scarf cut extending at least partially between the first and second axial ends;

actuating the wellbore isolation device and thereby radially expanding the sealing element to seal the wellbore at the location, wherein radially expanding the sealing element moves the extrusion limiting ring from a contracted state disposed about the sealing element to an expanded state, where the extrusion limiting ring is disposed about an outer radial surface of the slip wedge; and preventing with the extrusion limiting ring a material of the sealing element from extruding axially across the outer radial surface and into axial gaps formed between angularly adjacent slip segments of the set of slip segments;

wherein the extrusion limiting ring is movable between a contracted state, where the extrusion limiting ring is disposed about the sealing element, and an expanded state, where the extrusion limiting ring is disposed about the outer radial surface of the slip wedge;

wherein the scarf cut provides opposing angled surfaces coupled together in the contracted state with a frangible bond.

11. The method of claim 10, wherein the wellbore isolation device is selected from the group consisting of a frac plug, a bridge plug, a wellbore packer, a wiper plug, a cement plug, a sliding sleeve, and any combination thereof.

12. The method of claim 10, wherein actuating the wellbore isolation device to radially expand the sealing element comprises radially expanding the extrusion limiting ring as the sealing element radially expands.

13. The method of claim 10, wherein a radial shoulder is defined on an axial end of the sealing element and the extrusion limiting ring is positioned about the sealing element on the radial shoulder in the contracted state, and wherein radially expanding the sealing element comprises radially expanding the extrusion limiting ring and thereby enlarging a gap of the scarf cut.

14. The method of claim 13, wherein the extrusion limiting ring is bonded to the radial shoulder while forming the sealing element, the method further comprising breaking the extrusion limiting ring free from the radial shoulder as the sealing element radially expands.

15. The method of claim 10, further comprising:

radially expanding the extrusion limiting ring as the sealing element radially expands; and breaking the frangible bond as the extrusion limiting ring radially expands and thereby allowing the opposing angled surfaces to separate.

16. The method of claim 10, wherein the frangible bond extends circumferentially across a portion of the scarf cut to maintain the extrusion limiting ring in the contracted state, the method further comprising:

radially expanding the extrusion limiting ring as the sealing element radially expands; and breaking the frangible bond as the extrusion limiting ring radially expands.

17. The method of claim 10, wherein the frangible bond is disposed within at least a portion of the scarf cut to couple the opposing angled surfaces in the contracted state, the method further comprising:

radially expanding the extrusion limiting ring as the sealing element radially expands; and breaking the frangible bond as the extrusion limiting ring radially expands and thereby allowing the opposing angled surfaces to separate.

18. A well system, comprising:

a wellbore; and a wellbore isolation device conveyable within the wellbore and including:

an elongate mandrel;

a sealing element carried by the elongate mandrel;

a slip wedge positioned about the elongate mandrel axially adjacent the sealing element and providing an outer radial surface;

a set of slip segments circumferentially disposed about the elongate mandrel and at least a portion of the slip wedge; and an extrusion limiting ring having an annular body that provides a first axial end, a second axial end, and a scarf cut extending at least partially between the first and second axial ends, wherein the extrusion limiting ring is movable between a contracted state, where the extrusion limiting ring is disposed about the sealing element, and an expanded state, where the extrusion limiting ring is disposed about the outer radial surface of the slip wedge;

wherein the extrusion limiting ring is movable between a contracted state, where the extrusion limiting ring is disposed about the sealing element, and an expanded state, where the extrusion limiting ring is disposed about the outer radial surface of the slip wedge;

wherein the scarf cut provides opposing angled surfaces coupled together in the contracted state with a frangible bond.

19. The well system of claim 18, wherein the frangible bond extends circumferentially across a portion of the scarf cut, and the frangible bond is disposed within at least a portion of the scarf cut to couple the opposing angled surfaces in the contracted state.

* * * * *